US005902972A

United States Patent [19]

Nestor et al.

[11] Patent Number: 5,902,972

[45] Date of Patent: May 11, 1999

[54] THREE FUNCTION ROCKER/PUSH SWITCH

[75] Inventors: James Michael Nestor, Niles; Samuel Edward Penn, Cortland, both of Ohio

[73] Assignee: General Motors Corporation, Detroit, Mich.

[21] Appl. No.: 08/934,607

[22] Filed: Sep. 22, 1997

[51] Int. Cl.[6] ..... H01H 9/00; H01H 13/52; H01H 13/70

[52] U.S. Cl. ..... 200/1 B; 200/5 A; 200/517; 200/339

[58] Field of Search ..... 200/1 B, 5 R, 200/5 A, 18, 553, 557, 512–517, 315, 339

[56] References Cited

U.S. PATENT DOCUMENTS

| | | | |
|---|---|---|---|
| 3,103,570 | 9/1963 | Gibbs | 200/339 |
| 4,386,254 | 5/1983 | Eberhardt et al. | 200/339 |
| 4,654,488 | 3/1987 | Westfall | 200/5 R |
| 4,687,200 | 8/1987 | Shirai | 200/339 X |
| 5,087,798 | 2/1992 | Rohde et al. | 200/5 A |
| 5,115,108 | 5/1992 | Ogawa et al. | 200/1 B |
| 5,283,401 | 2/1994 | Schmucker | 200/6 A |
| 5,329,278 | 7/1994 | Dombroski | 200/553 X |
| 5,559,311 | 9/1996 | Gorbatoff | 200/339 X |
| 5,584,380 | 12/1996 | Naitou | 200/315 |
| 5,719,361 | 2/1998 | Lee | 200/1 B |
| 5,753,874 | 5/1998 | Kossakowski | 200/1 B |
| 5,804,780 | 9/1998 | Bartha | 200/5 A |

*Primary Examiner*—J. R. Scott
*Attorney, Agent, or Firm*—Cary W. Brooks

[57] ABSTRACT

The invention includes a three-position switch having a keycap connected to a housing for pivotal movement, and slidable movement in a vertical direction. The keycap is connected to the housing so that the keycap may be rocked to a first position in which one end of the keycap is depressed closing a first circuit. The keycap may also be rocked to a second position in which a second end of the keycap is depressed closing a second circuit. The keycap may also be pushed downwardly so that both ends of the keycap are depressed closing the first and second circuits simultaneously.

3 Claims, 2 Drawing Sheets

THREE FUNCTION ROCKER/PUSH SWITCH

TECHNICAL FIELD

This invention relates to electrical switches, and more particularly to electrical switches having more than two positions.

BACKGROUND OF THE INVENTION

In some vehicles, a switch system may be utilized to raise and lower a door window glass. Some of these systems include a separate switch for selectively activating a motor to raise the window while the switch is depressed, a separate switch for selectively activating a motor to lower the window, and a third switch to activate a motor to lower a window completely in an express mode at any time that the switch is depressed.

Other switch systems are known to include multi-dome dual detent switches having at least a first and second collapsible dome structure. The dome structures have a conductive pellet on an underside. An elongated action bar extends across and bridges the first and second collapsible dome structures. A keycap is positioned for pivotal movement between first and second forward positions, and first and second rear positions. The keycap includes an engagement bar extending downwardly near one end of the keycap and positioned to engage the action bar. When the keycap is rotated forward to a first position, the engagement bar forces the action bar to pivot in a direction towards the first dome causing the dome to collapse. Movement of the keycap still further forward causes the action bar to rotate towards the second dome member collapsing the same. The keycap may be moved to first and second backward or rear positions to reverse the order in which the domes are collapsed. Although these systems are capable of producing a sequence of four functions, the switch systems include a multitude of components which complicate the assembly process and must cooperate together consistently to assure the desired results are achieved.

The present invention provides advantages to and alternatives over the prior art.

SUMMARY OF THE INVENTION

The invention includes a three-position switch having a keycap connected to a housing for pivotal movement, and slidable movement in a vertical direction. The keycap is connected to the housing so that the keycap may be rocked to a first position in which one end of the keycap is depressed closing a first circuit. The keycap may also be rocked to a second position in which a second end of the keycap is depressed closing a second circuit. The keycap may also be pushed downwardly so that both ends of the keycap are depressed closing the first and second circuit simultaneously.

In a preferred embodiment, the keycap has an elongated structure with two opposite sides. Pivot rods extend outwardly from the housing, each being received in a respective elongated slot formed in a vertical direction in the side of the keycap. The keycap may be rocked by depressing first or second ends to close the first or second circuits as desired. Due to the elongated vertical slot, the entire keycap may be pushed downward so that the first and second ends of the keycap close the first and second circuits simultaneously. Preferably, the switch system includes a first and second collapsible dome structure each underlying in an associated end of the keycap. The dome structures include a conductive pellet on an underside which is positioned over an open circuit including spaced apart electrical traces on an underlying support substrate.

These and other objects, features and advantages of the present invention will become apparent from the following brief description of the drawings, detailed description and appended claims and drawings.

DESCRIPTION OF THE PREFERRED EMBODIMENT

Figure 1:
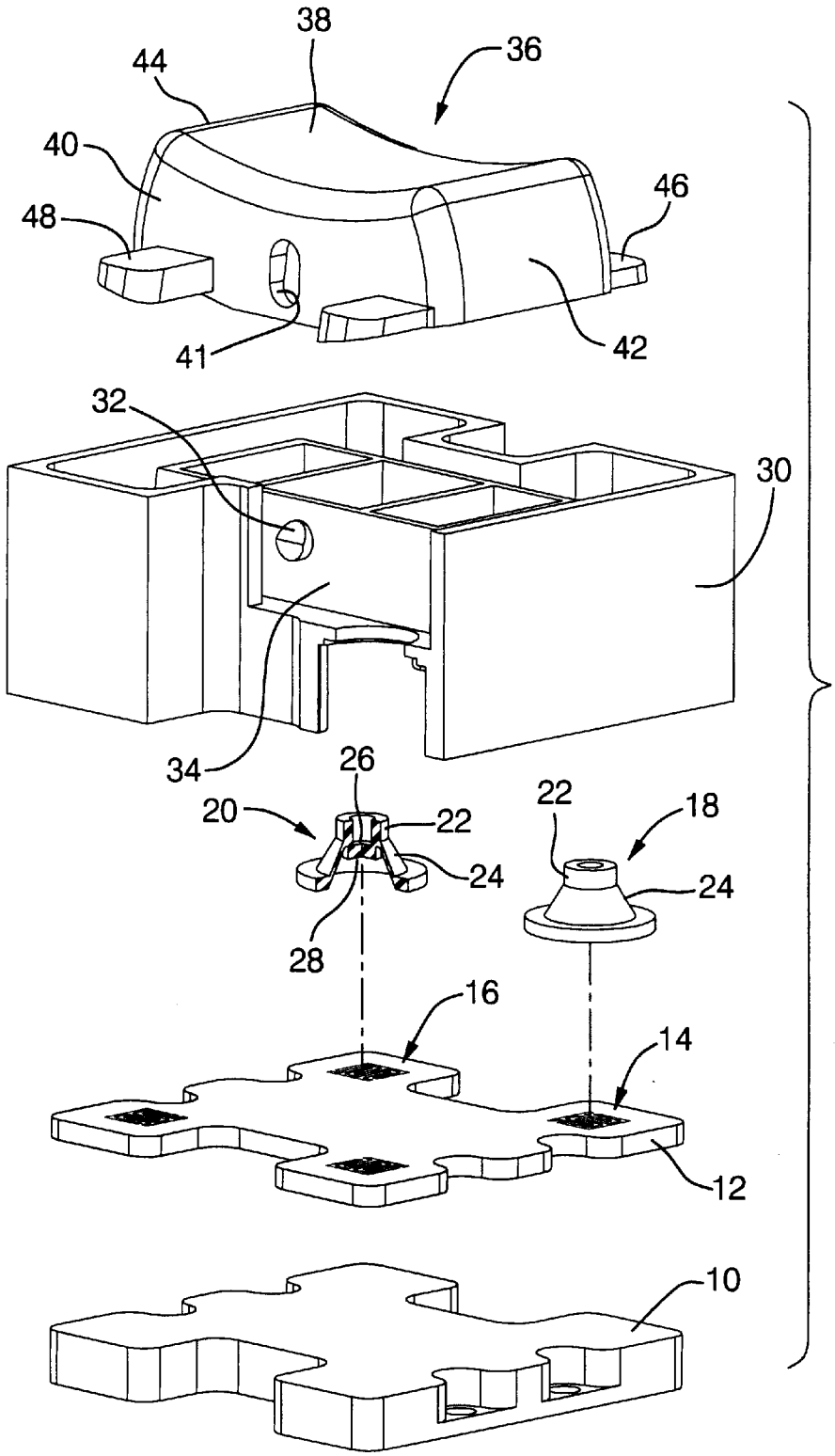
FIG. 1 is an exploded perspective view of a switch system according to the present invention.

Referring to FIG. 1, a switch system according to the present invention may include a base 10 for supporting a substrate 12 such as a printed circuit board. At least a portion of a first open circuit 14 and a portion of a second open circuit 16 are provided on the substrate 12. First and second collapsible domes 18, 20 are each positioned over an associated circuit 14, 16 respectively. Each collapsible dome 18, 20 is a nonmetallic, flexible polymeric material, preferably an elastomeric material such as a silicone based material. The collapsible domes 18, 20 may have a variety of configurations, but preferably has a resilient, annular outer ring 22 of a given thickness, and downwardly extending flexible side wall 24. A thinner membrane 26 underlines the annular ring 22 and an electrically conductive pellet 28 (best seen in FIGS. 2–4) is carried on the underside of the membrane 26. An open circuit is provided, for example, including two spaced apart electrical contacts or electrical traces on the substrate 12 underneath the electrically conductive pellet 28 so that upon collapse of the dome 18, 20, the electrically conductive pellet 28 engages the spaced apart traces and closes the associated circuit 14, 16 on the substrate 12.

The base 10, substrate 12, and collapsible domes 18, 20 may be received in a housing 30. The housing 30 may have any of a variety configurations provided that it is constructed and arranged to carry and support a keycap 36 for pivotal and slidable movement with respect to the housing 30. Preferably the housing includes first and second pivot rods 32 each extending from a wall 34 defining a portion of the housing 30. The keycap 30 may have a variety of configurations and may be round, oval or rectangular in cross section or may be of the pedestal type known to those skilled in the art. As shown in FIG. 1, preferably the keycap has a top surface 38, two opposed side walls 40, a first end 42 and second end 44. A first collapsible dome engagement surface 46 is provided near the first end 42 on the keycap. The engagement surface 46 may be immediately underneath the top surface 38 or may extend from the side walls 40 as shown in FIG. 1. The keycap 30 also includes a second collapsible dome engagement surface 48 near the second end 44 of the keycap and is similarly constructed as the first engagement surface 46.

Figure 2:
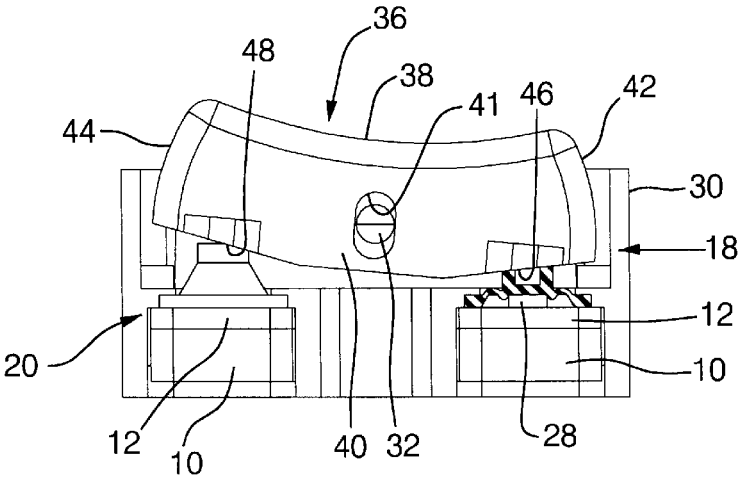
FIG. 2 is a sectional view of a switch system according to the present invention in a first position.

Referring to FIG. 2, the keycap 30 can be rocked or pivoted to a first position by an operator depressing the top surface 38 near the first end 42 so that the first engagement surface 46 collapses the first dome 18, closing the first circuit 14.

Figure 3:
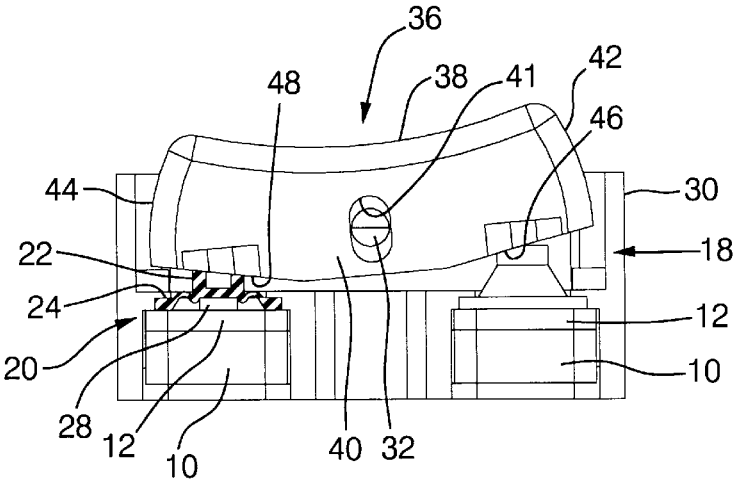
FIG. 3 is a sectional view of a switch system according to the present invention in a second position.

Referring to FIG. 3, likewise, the keycap 30 can be rocked or pivoted to a second position by an operator pushing downward on the top surface 38 near the second end 44 so that the second engagement surface 48 collapses the second dome 20, closing the second circuit 16.

Figure 4:
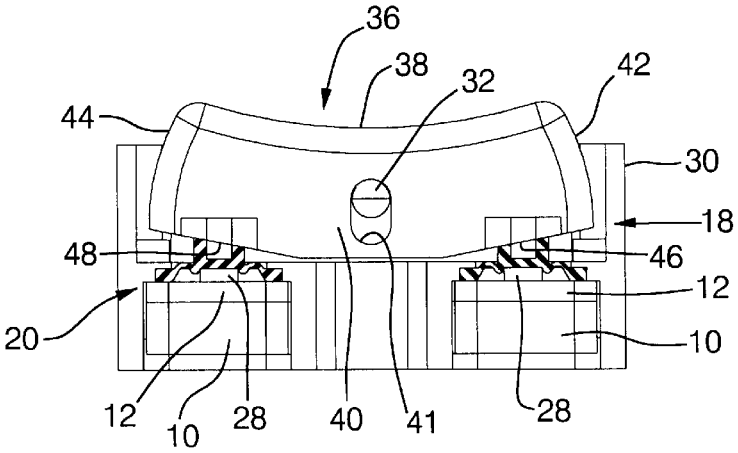
FIG. 4 is a sectional view of a switch system according to the present invention in a third position.

Referring to FIG. 4, the keycap may be pushed or slid downward wherein the pivot rod 32 slides in the slot 41 formed in the side wall 40 of the keycap. The operator supplies sufficient pressure on the top surface 38 on the keycap to cause both engagement surfaces 46, 48 to collapse the first and second domes 18, 20 respectively closing the first and second circuits 14, 16 simultaneously. A CPU or other suitable device may be provided in the vehicle to determine if both of the circuits 14, 16 have been closed simultaneously, so that a motor may be activated to cause a window to go up or down automatically on an express basis until the window is completely closed or completely open.

Accordingly, the present invention provides a three-position switch with a minimal number of parts to be assembled and which is constructed in a manner which will provide consistent and reliable operation of the switch in the three positions. Since the operator is required to firmly press downward on the top surface 38 of the switch preferably near both ends 42, 44 there can be no mistake on the operator's part in activating the associated motor in an express mode to raise or lower a window.

We claim:

1. A switch system comprising a substrate having at least a portion of a first and a second open circuit thereon, a first collapsible dome overlying an open portion of the first circuit and a second collapsible dome overlying an open portion of the second circuit, each dome having an electrically conductive element on the underside, a housing having two spaced apart vertical walls each having a pivot rod extending therefrom, and the housing overlying the substrate, a keycap having a top surface and two spaced apart downwardly extending side walls, each wall having an elongated vertical slot formed therein for receiving an associated pivot rod of the housing for pivotal and vertical slidable movement of the keycap with respect to the housing, said keycap having a first and second end, and so that the keycap may be pivoted to a first position in which the first end is depressed and the electrically conductive element associated with the first dome closes the first circuit, and so that the keycap may be pivoted to a second position wherein the second end is depressed and the electrically conductive element associated with the second dome closes the second circuit, and the keycap being slidable downwardly to a third position in which both the first and second ends are depressed and the electrically conductive elements associated with the first and second domes respectively close the first circuit and the second circuit simultaneously.

2. A switch system as set forth in claim 1 wherein each dome comprises an elastomer.

3. A switch systems as set forth in claim 1 wherein said keycap further comprises a dome engagement surface extending outwardly from the side wall of the keycap.

* * * * *